US005737907A

United States Patent [19]

Riley

[11] Patent Number: 5,737,907

[45] Date of Patent: Apr. 14, 1998

[54] MULTI-PURPOSE HORSE PACK FRAME

[76] Inventor: M. Orville Riley, P.O. Box 817, Townsend, Mont. 59644

[21] Appl. No.: 560,819

[22] Filed: Nov. 20, 1995

[51] Int. Cl.[6] ..... B68C 1/00

[52] U.S. Cl. ..... 54/37.1

[58] Field of Search ..... 54/37.1, 40.1; 224/905

[56] References Cited

U.S. PATENT DOCUMENTS 618,329 1/1899 Calvert ..... 54/37.1

5,267,428 12/1993 Mayo ..... 54/37.1

5,419,103 5/1995 Edwards ..... 54/37.1

*Primary Examiner*—Robert P. Swiatek

[57] ABSTRACT

A framework for securing sundry items to a pack horse and for use as a chair or commode. A tubular framework includes a harness frame, a support frame and hinge plates which retain one to the other. A number of looped weldments anchor harness pieces which support the frame to a pack horse and anchor load securing straps and ropes. Multiple sleeve couplers project from the support frame and detachable legs mount to the sleeves and are retained with clips to provide a camp seat. A commode ring also mounts to the support frame to provide a portable toilet.

14 Claims, 4 Drawing Sheets

MULTI-PURPOSE HORSE PACK FRAME

BACKGROUND OF THE INVENTION

The present invention relates to pack horse load supports and panniers and, in particular, to a folding pack frame which attaches to a pack horse for use in transporting sundry items. The frame also assembles into a camp chair and portable commode, once a camp is established.

Since time immemorial pack animals have been used for transporting any variety of items. Most commonly the transported items are secured directly to a saw-buck saddle, which is supported to the animal, or are contained in panniers that are mounted to the saddle. The saddle includes "X" crossed members and a variety of fasteners which anchor loading straps or separate storage containers or supports. Transport saddles having leather covered, looped anchors are also commonly used to secure the load or panniers.

Varieties of hard and soft sided panniers constructed from a variety of materials which can be mounted to the foregoing pack saddles have been developed in a variety of designs to contain transported materials without appreciably adding to the weight borne by the animal. Hard sided designs typically include contoured boxes which are supported from harnesses that fasten to the pack saddle. Soft sided panniers provide cloth or fabric cover pieces having harnesses sewn to the fabric. Straps, D-rings and other fasteners are fitted to the panniers to secure contained loads and permit external attachment of other items.

Soft sided panniers are also known which provide partially formed storage compartments and flaps that can be wrapped about the transported equipment. The latter panniers have demonstrated certain advantages in that for many odd shaped loads, the pannier can be adapted to fit the load without sacrificing storage space. Usable storage space is frequently lost with hard sided panniers where spaces occur between the stored items when packaged in the pannier.

A further problem with conventional pack equipment is that bulky items, such as hay bales, coolers, stoves and game, are difficult to support to the pack animal and pack saddle without obstructing the animal's legs and normal body movements.

In appreciation of the foregoing deficiencies, the present invention was developed to provide a folding, tubular metallic frame which readily mounts to conventional pack saddles. The frame provides a hinged shelf which projects from the side of the pack animal and is capable to supporting numerous bulky items. The frame is also constructed to accommodate other utilitarian uses within an established camp, most notably as a chair or portable toilet.

SUMMARY OF THE INVENTION

It is a primary object of the invention to provide a multi-purpose pack frame that is adaptable for mounting to pack animals, such as a horse.

It is a further object of the invention to provide a pack frame in a hinged construction having a harness supported back frame that mounts to the animal and a support frame that folds away from the animal to provide a support shelf.

It is a further object of the invention to array the support frame with a number of fasteners compatible with conventional harness rigging, ropes and other strap fasteners.

It is a further object of the invention to provide cross bracing between the peripheral frame sections and members to adequately contain and support a load.

It is a yet further object of the invention to provide couplers at the frame to receive multiple legs, such that the frame can be used as a chair when removed from the pack animal.

It is a further object of the invention to construct the frame to accommodate a commode seat to permit use of the frame as a portable toilet.

Various of the foregoing objects, advantages and distinctions of the invention are obtained in the following described construction. The frame is constructed of a formed tubular metal stock to provide a back or harness frame and a support shelf. U-shaped peripheral frame pieces define the periphery of the harness and support frames and are retained to one another at a pair of hinge brackets. Cross-braces extend between the peripheral frame pieces. A number of anchor loops are fitted to the frames to provide anchor points for the harness, straps, ropes and the like, which are used to secure the frame to the animal and items to the support frame.

A number of tubular sleeves project from the support frame. Tubular legs couple to the sleeves and are retained with interlocking fasteners. The pack frame is usable as a chair, either alone or with a covering saddle blanket. The frame pieces are also constructed to receive a commode seat or ring. The seat can be hinged to the support frame and permits use of the pack frame as a portable toilet.

Still other objects, advantages and distinctions of the invention will become more apparent from the following description with respect to the appended drawings. To the extent various other embodiments, modifications and improvements have been considered, they are described as appropriate. The invention should therefore not be literally construed to the following description nor in limitation of the invention. Rather, the invention should be interpreted within the broad scope of the further appended claims.

DESCRIPTION OF THE PREFERRED EMBODIMENT

Figure 1:
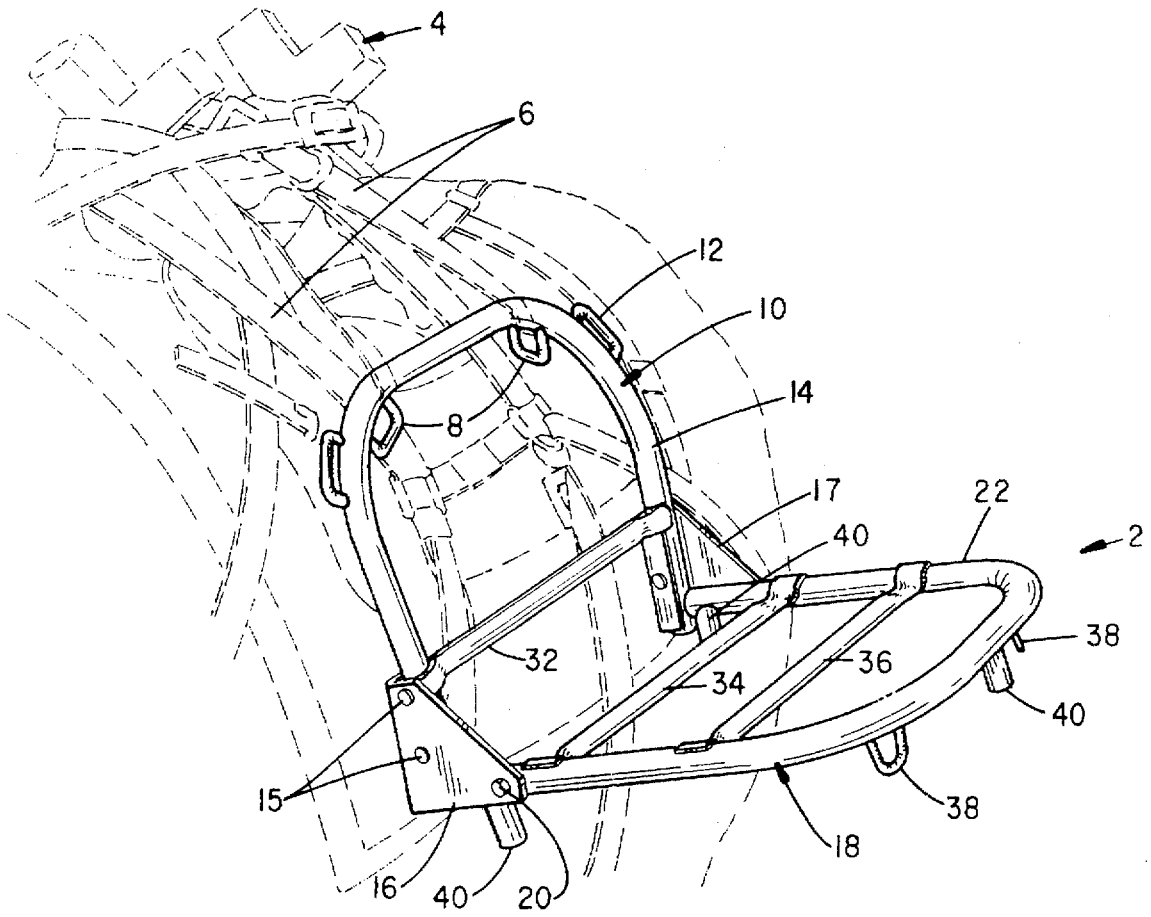
FIG. 1 is a perspective drawing showing the pack frame folded open and mounted to a pack horse and cross-back saddle.

Referring to FIG. 1, a perspective drawing is shown to the pack frame 2 as it typically appears when mounted to a saw-buck saddle 4, shown in phantom line. A pair of harness straps 6 extend from a pair of looped weldments 8 at a harness or back frame 10. The weldments 8 and additional looped weldments 12 project from a U-shaped, sectional frame 14 of the harness frame 10 and serve as anchors for the harness 6 and loading straps or ropes (not shown).

A pair of gusset brackets 16 are fastened with rivets 15 to the frame piece 14 adjacent a lower end. A support frame 18, which bears the load, is hinged to the brackets 16 and 17 at a pair of hinge pins 20, only one of which is shown.

Figure 3:
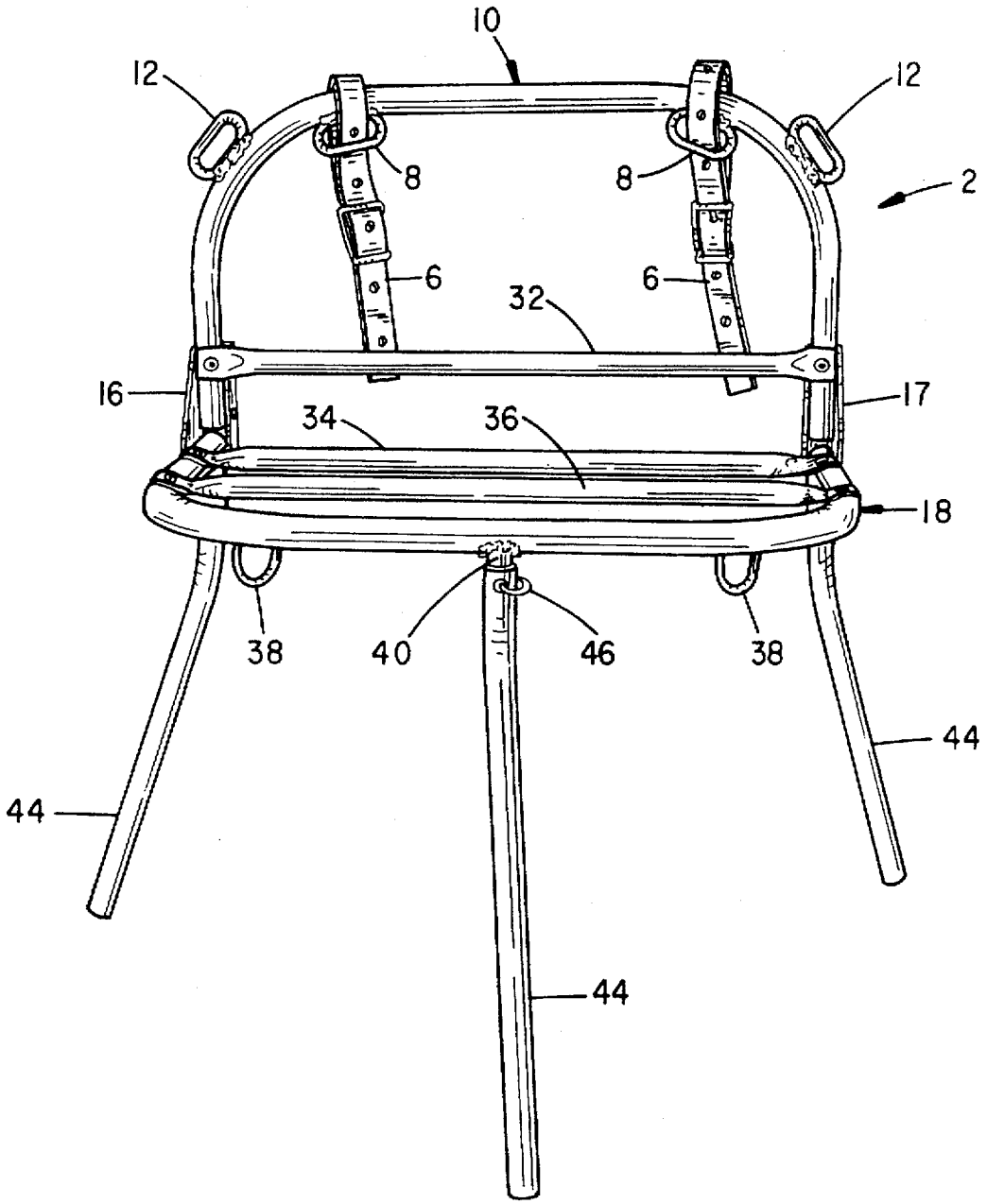
FIG. 3 is a perspective drawing showing the frame configured as a camp chair.

The support frame 18 provides a complementary U-shaped, tubular sectional frame 22 which is secured to the hinge pins 20 to rotate relative to the harness frame 10 and the hinge brackets 16, 17. The frame 22 is mounted such that when folded down, the inner ends of the frame 22 abut the lower ends of the frame 14 to maintain an approximate 90 degree relationship to one another, reference FIG. 3. The frame 14 therefore also acts a stop for the load support frame 18.

Figure 2:
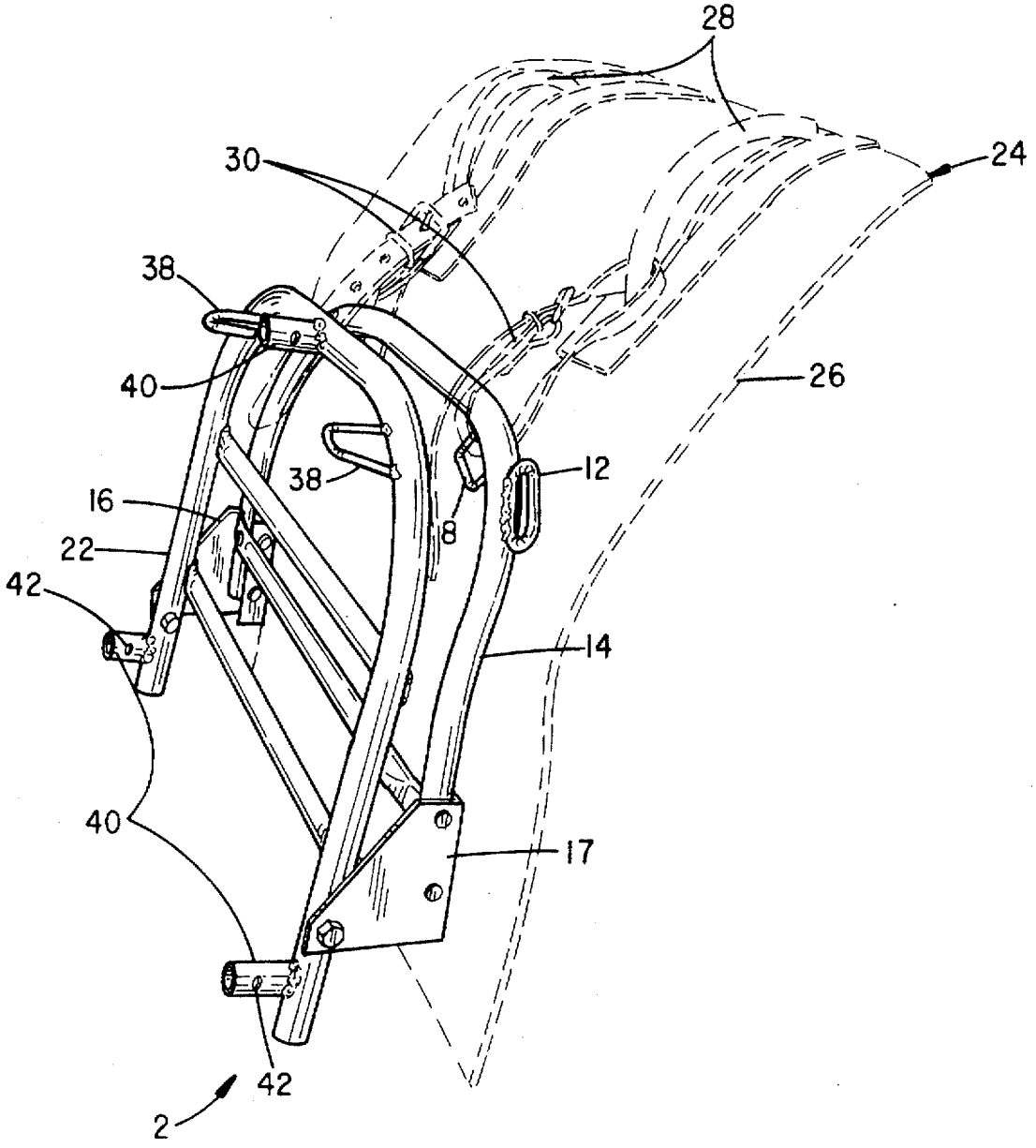
FIG. 2 is a perspective drawing showing the frame folded closed and mounted to another common pack saddle.

FIG. 2 depicts a view of the frame 2, when folded closed. FIG. 2 also depicts the mounting of the pack frame 2 to an alternative pack saddle 24, commonly referred to as a "decker" saddle. The saddle 24 provides a blanket 26 and to which are sewn a pair of leather covered loops 28. Harness straps 30 are supported between the loops 28 and the weldments 8 retain the frame 2 to the saddle 24.

Projecting across the harness frame and support frames 14 and 22 are a number of cross-braces 32, 34 and 36. The cross-braces stabilize the frames 14 and 22 and provide additional support surfaces for contained loads borne by the frame 2.

In normal use, the assembly 2 finds application for carrying a wide variety of items useful in a horse based camp. For example, camping equipment, hay, coolers, stoves, tents and other bulky items are readily supported at the shelf formed by the support frame 18. When not in use, the configuration of the frame 2 is such that the frame 2 can accommodate alternative uses within an established camp. Some of such uses are shown and discussed at FIGS. 3 and 4 below.

The frame 2 is presently constructed of a tubular steel, such as ½ or ¾ inch tubing. The tubing is bent to the depicted "U" shaped sections 14, 22 and the weldments 8, 12 are welded to the frame sections 14, 22. Also secured to the frame section 22 are a pair of looped weldments 38 and a number of tubular sleeves 40. The weldments 8, 12 and 38 can be mounted anywhere about the periphery of the frame sections 14, 22. The locations and numbers are selected to best accommodate use of the pack frame 2 either with a pack animal or about a pitched camp.

The sleeves 40 each include a bored aperture 42 which aligns with an aperture at a mating leg 44. Hair pin clips 46 mount through the aligned holes to the legs 44 to the frame 2, reference FIG. 3. Upon removing the pack frame 2 from a pack horse and securing the legs 44, the assembly can serve as a camp chair. In such instance, a saddle blanket might be draped over the assembly 2 to provide cushioned support.

Figure 4:
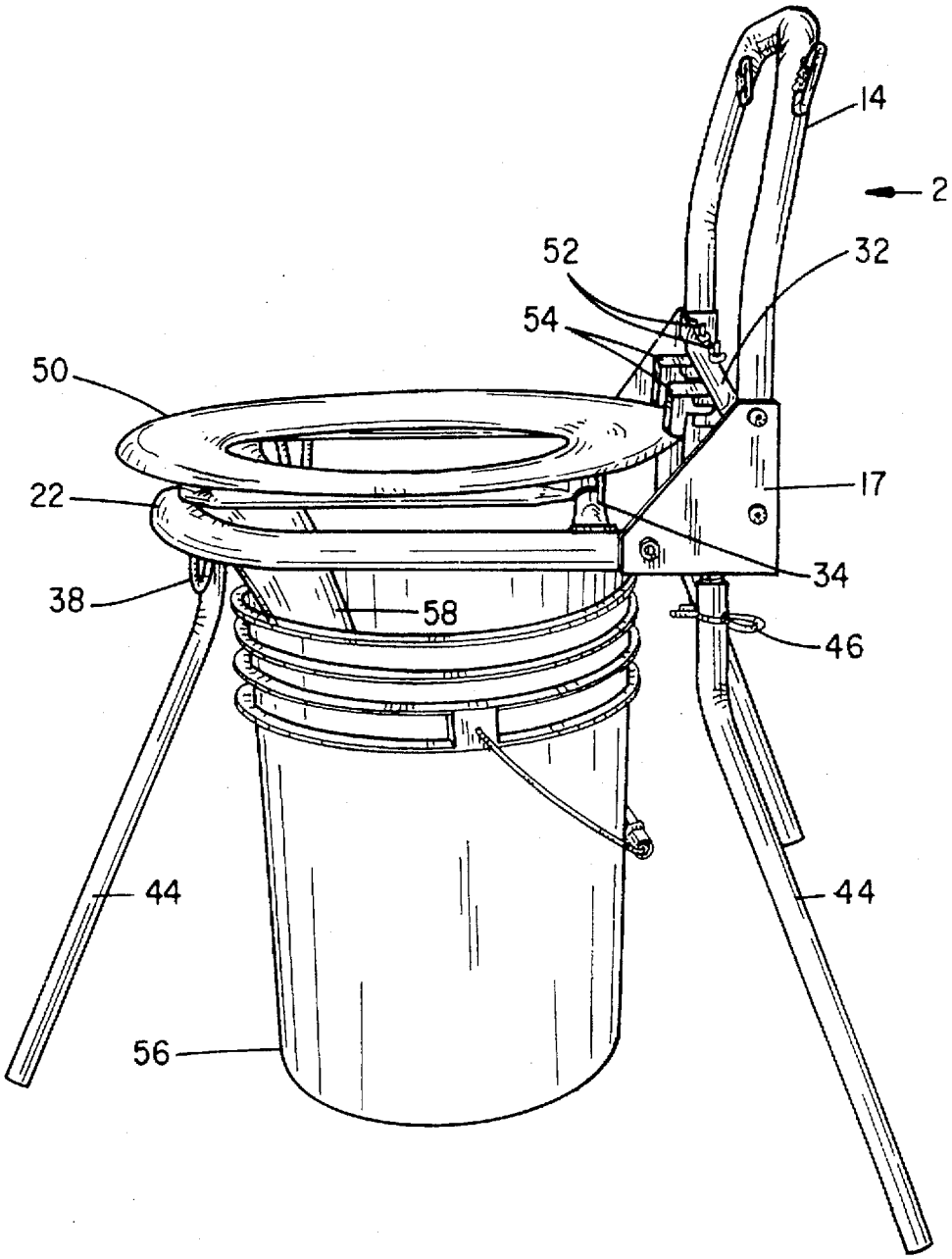
FIG. 4 is a perspective drawing showing the frame configured as a portable commode.

FIG. 4 shows yet another adaptation of the assembly 2 for use as a portable toilet. In this instance, a commode seat 50 is mounted to the pack frame 2. A pair of bolt fasteners 52 extend from hinge assemblies 54 and retain the seat 52 to the cross-brace 32. The cross-brace 36 is normally removed to facilitate use of the seat 50 in relation to a pail 56 positioned below the seat 50. A plastic bag 58, which is shown in partial section, might also be supported to the frame piece 22 and be draped within the pail 56. With the collection of waste matter, the bag 58 can be buried. Alternatively, the bag 58 can be used without the benefit of a pail 56.

While the invention has been described with respect to a presently preferred construction and various considered modifications and improvements, still other constructions may suggest themselves to those skilled in the art. The invention should therefore be construed to include all those equivalent embodiments within the spirit and scope of the following claims.

What is claimed is:

1. A saddle pack frame comprising:

a) a harness frame including a first frame section having a plurality of anchor means arrayed about said first section;

b) a support frame including a second frame section having a plurality of anchor means arrayed about said second section;

c) hinge means connecting said harness and support frames to one another, wherein said second frame section abuts a lower end of said first frame section at said hinge means, such that when folded open, rotation of said second frame section is limited by the first frame section;

d) a plurality of legs and wherein said second frame section includes coupler means connecting said legs to said second frame section, whereby said pack frame defines a chair frame; and e) harness means for connecting said harness frame to a pack animal.

2. Apparatus as set forth in claim 1 wherein said anchor means comprises a plurality of looped weldments which project from said first and second frame sections.

3. Apparatus as set forth in claim 1 wherein a plurality of cross braces are mounted to said first and second frame section.

4. Apparatus as set forth in claim 3 wherein said cross braces detachably mount to said first and second frame sections.

5. Apparatus as set forth in claim 1 wherein a commode seat is mounted to said support frame.

6. A saddle pack frame comprising:

a) a harness frame including a first frame section having a plurality of looped weldments which project from said first frame section;

b) a support frame including a second frame section having a plurality of looped weldments which project from said second frame section and wherein a commode seat is mounted to said support frame;

c) a plurality of cross braces mounted to said first and second frame sections;

d) hinge means connecting said harness and support frames to one another; and e) harness means for connecting said harness frame to a pack animal.

7. Apparatus as set forth in claim 6 wherein said second frame section abuts a lower end of said first frame section at said hinge means, such that when folded open, rotation of said second frame section is limited by said first frame section.

8. A saddle pack frame comprising:

a) a harness frame including a first frame section having a plurality of looped weldments which project from said first frame section;

b) a support frame including a second frame section containing a plurality of legs and a plurality of looped weldments arrayed about said second section, wherein said second frame section abuts a lower end of said first frame section, such that when folded open, rotation of said second frame section is limited by the first frame section, and wherein said second frame section includes coupler means connecting said legs to said second frame section, whereby said pack frame can be assembled into a chair frame;

c) hinge means connecting said harness had support frames to one another; and d) harness means for connecting said harness frame to a pack animal.

9. Apparatus as set forth in claim 8 wherein a commode seat is mounted to said support frame.

10. Apparatus as set forth in claim 8 wherein a plurality of cross braces are mounted to said first and second frame sections.

11. Apparatus as set forth in claim 10 wherein at least one of said cross braces is detachably mounted to said first and second frame sections.

12. A saddle pack frame comprising:

a) a harness frame including a first frame section having a plurality of anchor means arrayed about said first section;

b) a support frame including a second frame section having a plurality of anchor means arrayed about said second section and wherein a commode seat mounts to said second frame;

c) hinge means connecting said harness and support frames to one another; and d) harness means for connecting said harness frame to a pack animal.

13. Apparatus as set forth in claim 12 wherein said second frame section abuts a lower end of said first frame section it said hinge means, such that when folded open, rotation of said second frame section is limited by the first frame section.

14. Apparatus as set forth in claim 12 including a plurality of legs and wherein said second frame section includes coupler means connecting said legs to said second frame section, whereby said pack frame defines a chair frame.

* * * * *